US012768551B2

(12) United States Patent
Jakubov

(10) Patent No.: US 12,768,551 B2
(45) Date of Patent: Oct. 20, 2026

(54) HVAC DISINFECTION SYSTEM AND METHODS OF USE THEREOF

(71) Applicant: Eugene Jakubov, Richmond Hill (CA)

(72) Inventor: Eugene Jakubov, Richmond Hill (CA)

( * ) Notice: Subject to any disclaimer, the term of this patent is extended or adjusted under 35 U.S.C. 154(b) by 360 days.

(21) Appl. No.: 18/279,915

(22) PCT Filed: Mar. 7, 2022

(86) PCT No.: PCT/CA2022/050320
§ 371 (c)(1),
(2) Date: Sep. 1, 2023

(87) PCT Pub. No.: WO2022/187938
PCT Pub. Date: Sep. 15, 2022

(65) Prior Publication Data

US 2024/0142123 A1 May 2, 2024

Related U.S. Application Data

(60) Provisional application No. 63/158,080, filed on Mar. 8, 2021.

(51) Int. Cl.
*F24F 8/22* (2021.01)

(52) U.S. Cl.
CPC ..... *F24F 8/22* (2021.01)

(58) Field of Classification Search
CPC ..... A61L 9/20; F24F 8/22
See application file for complete search history.

(56) References Cited

U.S. PATENT DOCUMENTS

| | | | | |
|---|---|---|---|---|
| 2005/0191205 | A1 | 9/2005 | Uslenghi et al. | |
| 2006/0045817 | A1 | 3/2006 | Horne et al. | |
| 2006/0207267 | A1 * | 9/2006 | Erdman | F24F 8/192 62/78 |

FOREIGN PATENT DOCUMENTS

| | | | |
|---|---|---|---|
| CA | 2823458 | A1 | 7/2014 |
| CN | 1583181 | A | 2/2005 |

* cited by examiner

*Primary Examiner* — Kevin Joyner

(57) ABSTRACT

A disinfecting system for mounting within an HVAC system, comprising an adjustable frame, which comprises a first holding structure; and a second holding structure, wherein the first holding structure and the second holding structure are slidably moveable with respect to each other, thereby adjusting the width of the adjustable frame; and a lamp adapted to be fixedly connected to the adjustable frame.

8 Claims, 12 Drawing Sheets

HVAC DISINFECTION SYSTEM AND METHODS OF USE THEREOF

CROSS-REFERENCE TO RELATED APPLICATIONS

This application is a national stage filing under 35 U.S.C. § 371 of international application number PCT/CA2022/050320, filed Mar. 7, 2022, which claims priority to U.S. patent application No. 63/158,080 filed Mar. 8, 2021. The contents of these applications are incorporated herein by reference in their entirety for all purposes.

FIELD OF THE INVENTION

The present invention relates generally to disinfection systems and more specifically to disinfection systems for mounting within HVAC systems.

BACKGROUND OF THE INVENTION

UV-C light is known as one of the most effective disinfectants against biological micro-organisms, such as viruses, bacteria, mold and fungi. It is being commonly used by hospitals, medical laboratories and pharma companies to disinfect their premises from various biological contaminations.

There are many viruses, bacteria and fungi that are known to be air borne, meaning they could travel tens of meters while suspended in the air. This quality results in high levels of distribution of such micro-organisms throughout indoors premises by the air circulating through air conditioning and HVAC systems operating therein.

It is known that the most effective means of distribution control and general disinfection of the air from micro-organisms is by installing UV-C lamps inside HVAC systems. This approach has been on the growth in the past years, although facing several problems. One problem is that while installing a UV-C lamp inside an HVAC system, there are limitations on the size and power of the lamps that could be used. When reflective surfaces are installed inside an HVAC system, their reflecting qualities are reduced by debris and dust travelling through the ducts and staining the reflective surfaces.

Another problem is that in order to achieve the most effective disinfection, the lamp should be installed in the center of a duct with the reflective surfaces attached to the opposite sides of the duct to prevent the air passing behind the reflective surfaces, hidden from the effect of the UV-C light. Since various sizes of ducts are being used in residential and commercial properties, it is impossible to adjust one-size-fits-all installation.

SUMMARY OF THE INVENTION

The present invention seeks to provide an improved disinfection system.

There is thus provided in accordance with an embodiment of the present invention a disinfecting system for mounting within an HVAC system, comprising an adjustable frame, which comprises a first holding structure; and a second holding structure, wherein the first holding structure and the second holding structure are slidably moveable with respect to each other, thereby adjusting the width of the adjustable frame; and a lamp adapted to be fixedly connected to the adjustable frame.

Preferably, at least a portion of the adjustable frame is adapted to be inserted into at least one opening formed in a duct of the HVAC system.

Further preferably, the first holding structure comprises a first base element and a pair of first rails extending transversely with respect thereto, and wherein the first rails each have a first base wall having a first width; and wherein the second holding structure comprises a second base element and a pair of second rails extending transversely with respect thereto, and wherein the second rails each have a second base wall having a second width, wherein the second width differs from the first width.

Still further preferably, the first holding structure comprises a first base element and a pair of first rails extending transversely with respect thereto, and wherein the first rails each have a first base wall having a first width; and wherein the second holding structure comprises a second base element and a pair of second rails extending transversely with respect thereto, and wherein the second rails each have a second base wall having a second width, wherein the second width differs from the first width.

Yet further preferably, the first holding structure has a first groove for releasable insertion of a first reflective surface assembly and the second holding structure has a second groove for releasable insertion of a second reflective surface assembly.

In accordance with an embodiment of the present invention, the lamp is adapted to be attached to the adjustable frame such that it is disposed in a central location between the first reflective surface assembly and the second reflective surface assembly. Preferably, the second base wall is slidably moveable relative to the first base wall. Further preferably, the first reflective surface assembly has a first rim for removal thereof from the first groove and the second reflective surface assembly has a second rim for removal thereof from the second groove.

Still further preferably, at least one notch is provided on the first or second rails, said first or second rails are configured to be cut along the at least one notch, thereby adjusting the adjustable frame to different sizes of the duct. Yet further preferably, at least one of the first and second reflective surface assemblies has a circumferential holder receiving a mirror therein.

In accordance with an embodiment of the present invention, the lamp is connected to the adjustable frame through a bracket, which is fixedly connected to at least one of the first and second holding structures.

Preferably, the first and second rails each have a plurality of axially spaced openings that are formed on a base wall of the first and second rails. Further preferably, the first holding structure comprises a first U-shaped structure and a pair of first rails connected thereto and extending transversely therefrom, and the second holding structure comprises a second U-shaped structure and a pair of second rails connected thereto and extending transversely therefrom such that the first U-shaped structure is adapted to be inserted into a first opening formed in a duct of said HVAC system and the second U-shaped structure is adapted to be inserted into a second opening formed in the duct, and the lamp is adapted to be inserted through a third opening formed in the duct and located between the first and second openings.

Still further preferably, the first opening and the second opening are formed on two opposite sides of the duct, such that the reflective surface assemblies abut the opposite sides of the duct and the lamp is positioned at a central location of the duct to provide for optimal light distribution throughout the volume of a passing air.

In accordance with an embodiment of the present invention, a disinfecting system for mounting within an HVAC system, comprising: an adjustable frame, configured for adjustment of the width thereof, and having a first groove and a second groove disposed on the opposite sides of the adjustable frame; a first reflective surface assembly configured to be releasably inserted into the first groove and a second reflective surface assembly configured to be releasably inserted into the second groove; and a lamp configured to be connected to the adjustable frame and located between the first and second reflective surface assemblies.

Preferably, the adjustable frame, comprises a first holding structure; and a second holding structure; wherein the first holding structure and the second holding structure are slidably moveable with respect to each other, thereby adjusting the width of the adjustable frame. Further preferably, at least a portion of the adjustable frame is adapted to be inserted into at least one opening formed in a duct of the HVAC system.

Still further preferably, the first holding structure comprises a first base element and a pair of first rails extending transversely with respect thereto, and wherein the first rails each have a first base wall having a first width; and wherein the second holding structure comprises a second base element and a pair of second rails extending transversely with respect thereto, and wherein the second rails each have a second base wall having a second width, wherein the second width differs from the first width.

Yet further preferably, the first holding structure contains the first groove for releasable insertion of the first reflective surface assembly and the second holding structure contains the second groove for releasable insertion of the second reflective surface assembly.

In accordance with an embodiment of the present invention, the lamp is adapted to be attached to the adjustable frame such that it is disposed in a central location between the first reflective surface assembly and the second reflective surface assembly.

Preferably, the second base wall is slidably moveable relative to the first base wall. Further preferably, the first reflective surface assembly has a first rim for removal thereof from the first groove and the second reflective surface assembly has a second rim for removal thereof from the second groove. Still further preferably, at least one notch is provided on the first or second rails, the first or second rails are configured to be cut along the at least one notch, thereby adjusting the adjustable frame to different sizes of the duct.

Yet further preferably, at least one of the first and second reflective surface assemblies has a circumferential holder receiving a mirror therein. In accordance with an embodiment of the present invention, the lamp is connected to the adjustable frame through a bracket, which is fixedly connected to at least one of the first and second holding structures.

Preferably, the first and second rails each have a plurality of axially spaced openings that are formed on a base wall of the first and second rails. Further preferably, the first holding structure comprises a first U-shaped structure and a pair of first rails connected thereto and extending transversely therefrom, and the second holding structure comprises a second U-shaped structure and a pair of second rails connected thereto and extending transversely therefrom such that the first U-shaped structure is adapted to be inserted into a first opening formed in a duct of the HVAC system and the second U-shaped structure is adapted to be inserted into a second opening formed in the duct, and the lamp is adapted to be inserted through a third opening formed in the duct and located between the first and second openings.

Still further preferably, the first opening and the second opening are formed on two opposite sides of the duct, such that the reflective surface assemblies abut the opposite sides of the duct and the lamp is positioned at a central location of the duct to provide for optimal light distribution throughout the volume of a passing air.

BRIEF DESCRIPTION OF THE DRAWINGS

The present invention will be understood and appreciated more fully from the following detailed description, taken in conjunction with the drawings in which.

DETAILED DESCRIPTION OF EMBODIMENTS OF THE INVENTION

Figure 1:
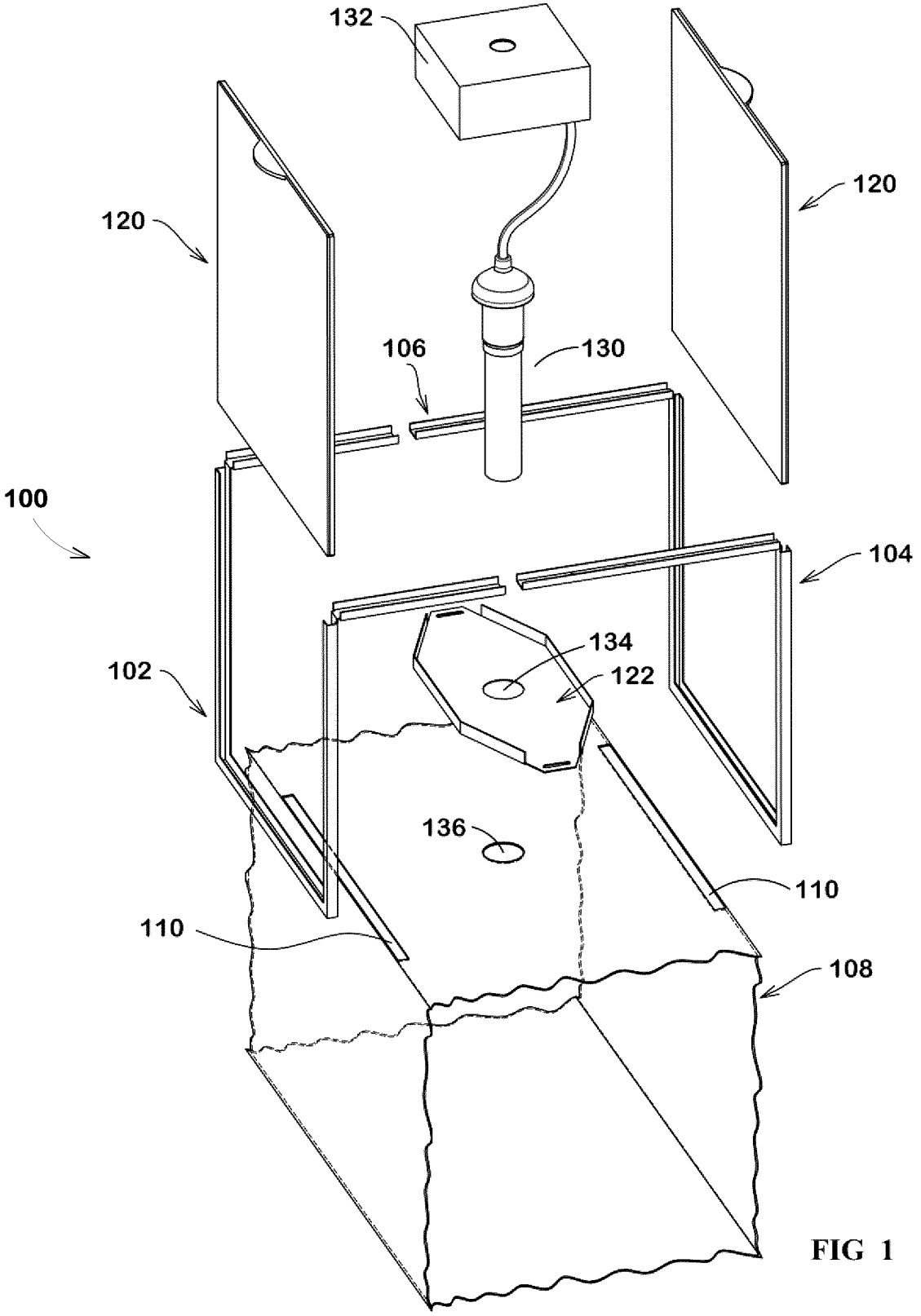
FIG. 1 is a simplified exploded view illustration of a disinfection system constructed and operative in accordance with an embodiment of the present invention.

Reference is now made to FIG. 1, which is a simplified exploded view illustration of a disinfection system constructed and operative in accordance with an embodiment of the present invention.

A disinfection system 100 is seen in FIG. 1, which preferably includes a first holding structure 102 and a second holding structure 104. The first and second holding structures 102 and 104 are configured to be slidably coupled to each other to form an adjustable frame 106. It is a particular feature of an embodiment of the present invention that the adjustable frame 106 can be adjusted to fit different sizes of ducts 108, forming part of an HVAC system.

Openings 110 are preferably formed in the duct 108 for insertion of a portion of the adjustable frame 106 therethrough, as described in detail hereinbelow.

It is a further particular feature of an embodiment of the present invention that a reflective surface assembly 120 is adapted to be removably mounted onto a portion of the first holding structure 102 and onto a portion of the second holding structure 104.

It is additionally seen in FIG. 1 that a bracket 122 is adapted to be fixedly coupled to the first and second holding structures 102 and 104 upon mounting thereof into the duct 108. A UV-C lamp 130 is preferably coupled with an electrical box 132. The UV-C lamp 130 is configured to be inserted through an opening 134 in the bracket 122 and an opening 136 formed in the duct 108 and the electrical box 132 is configured to be supported on the bracket 122.

Figure 2:
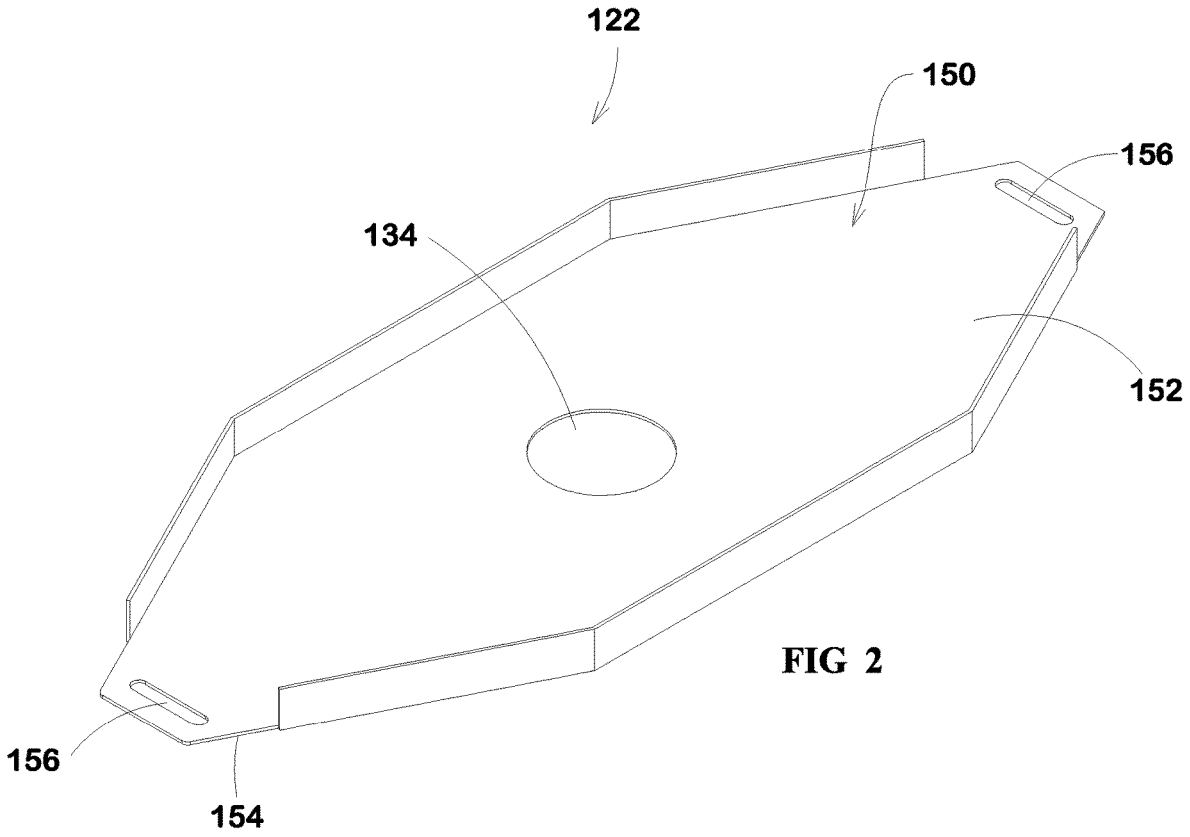
FIG. 2 is a simplified pictorial illustration of a bracket forming part of the disinfection system of FIG. 1.

Reference is now made to FIG. 2, which is a simplified pictorial illustration of the bracket 122 forming part of the disinfection system 100 of FIG. 1.

Figure 3B:
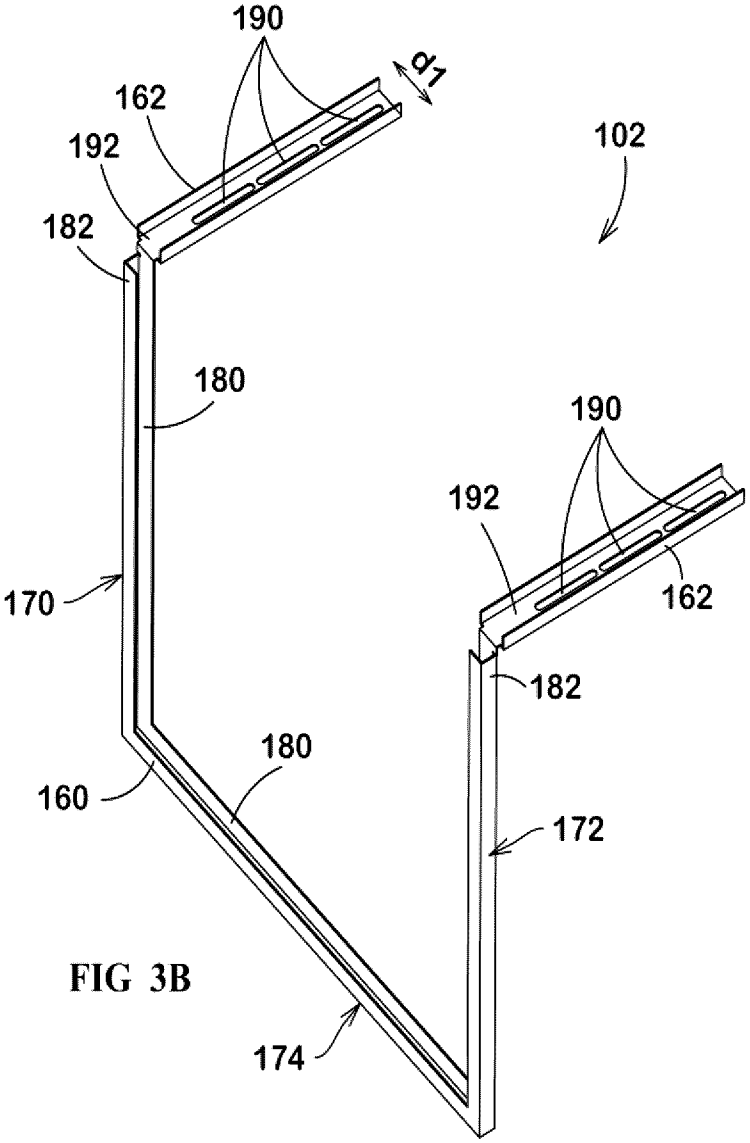
FIGS. 3A and 3B are simplified pictorial view illustrations of a first holding structure, forming part of the disinfection system of FIG. 1, shown from two different directions.
Figure 3A:
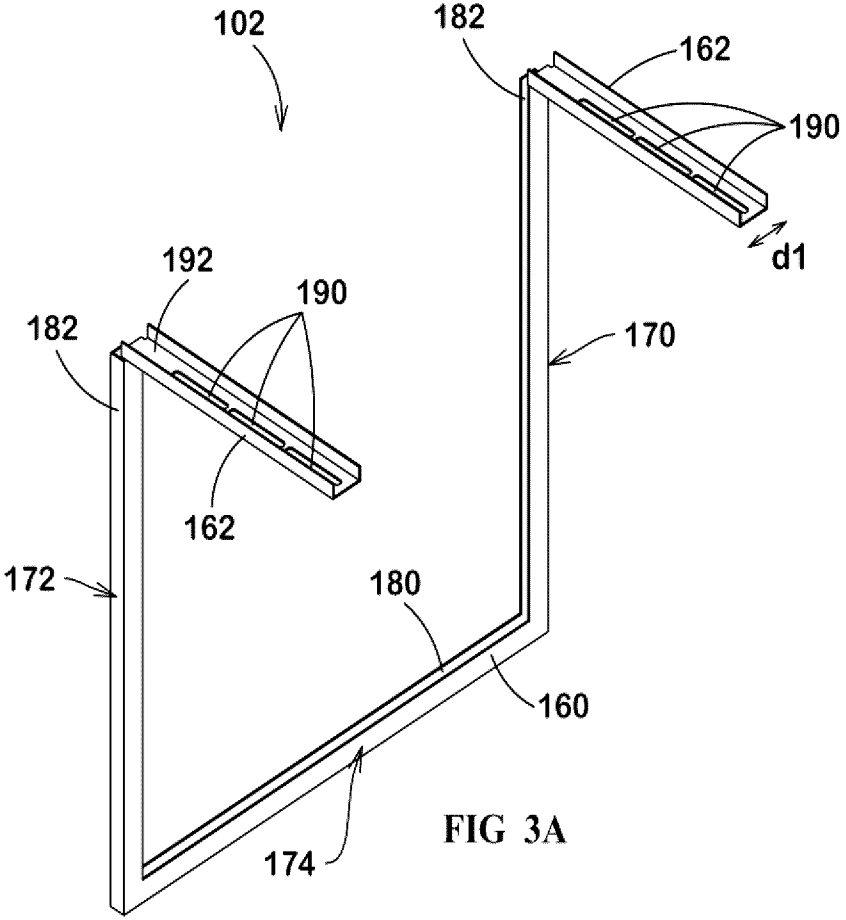

It is seen in FIG. 2 that the bracket 122 is a preferably integrally made element having a wall portion 150, defining an upwardly facing surface 152 and a downwardly facing surface 154. Opening 134 is formed in wall portion 150. Typically, two openings 156 are formed on opposite sides of the wall portion 150 and configured for attachment of the bracket 122 to the adjustable frame 106. Reference is now made to FIGS. 3A and 3B, which are simplified pictorial view illustrations of the first holding structure 102, forming part of the disinfection system 100 of FIG. 1, shown from two different directions.

It is seen in FIGS. 3A and 3B that the first holding structure 102 preferably comprises a U-shaped element 160 and typically two identical rails 162 being coupled thereto or integrally made therewith.

The U-shaped element 160 defines a first rod 170, a second rod 172 and connecting rod 174 extending generally transversely with respect to the first and second rods 172 and 174 and connecting therebetween. The U-shaped element 160 preferably has a U-shaped cross-section defining a circumferential groove 180 therewithin. The first and second rods 170 and 172 each have a first end 182 to which one of the rails 162 is connected. It is seen in FIGS. 3 A and 3B that rails 162 generally extend perpendicularly with respect to the first and second rods 170 and 172.

It is also seen in FIGS. 3A and 3B that rails 162 preferably have a U-shaped cross-section and a plurality of axially spaced openings 190 are formed on a base wall 192 of the rails 162. The width of the base wall 192 is d1.

Figure 4:
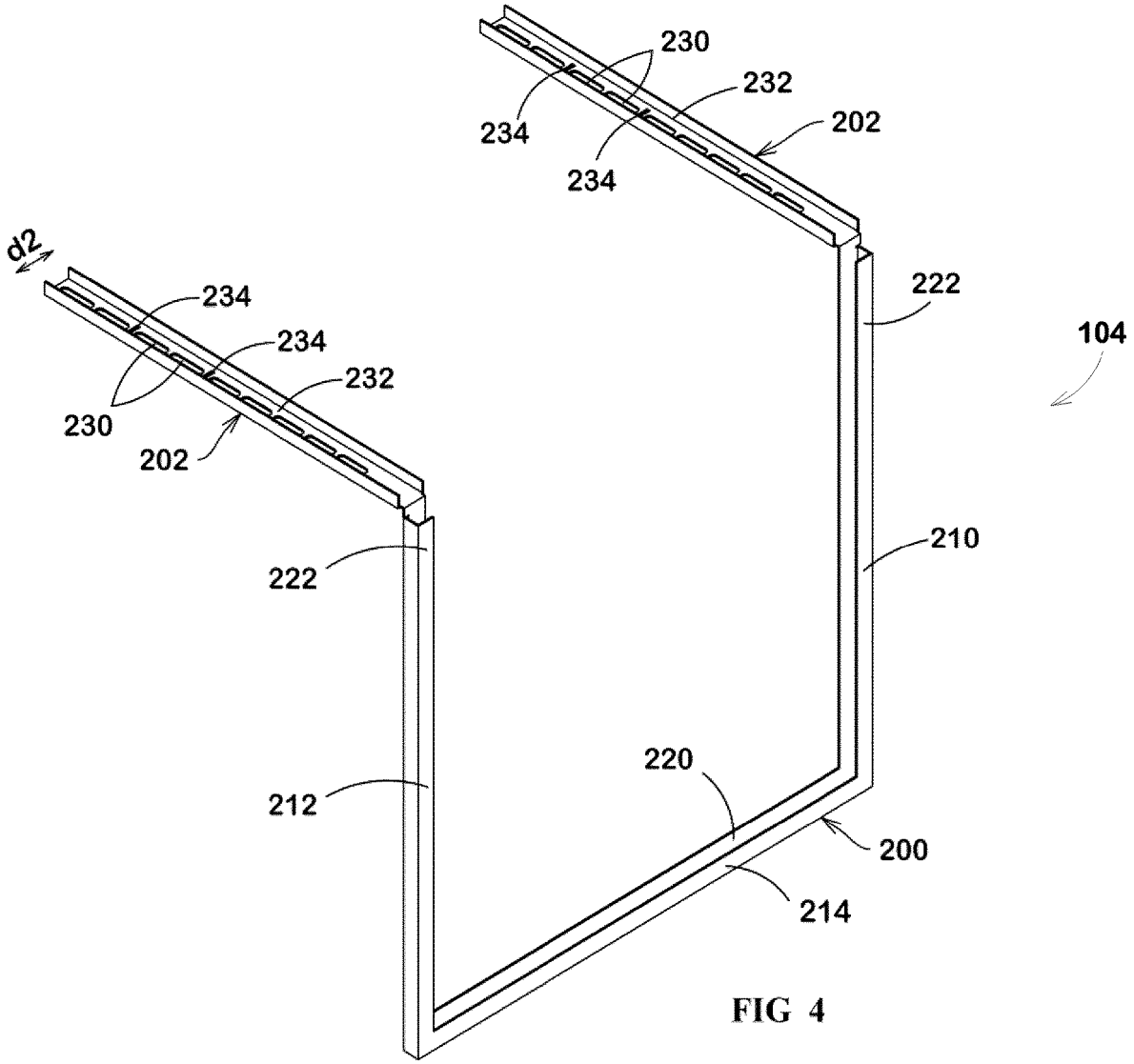
FIG. 4 is a simplified pictorial view illustration of a second holding structure, forming part of the disinfection system of FIG. 1.

Reference is now made to FIG. 4, which is a simplified pictorial view illustration of the second holding structure 104, forming part of the disinfection system 100 of FIG. 1.

It is seen in FIG. 4 that the second holding structure 104 preferably comprises a U-shaped element 200 and typically two identical rails 202 being coupled thereto or integrally made therewith.

The U-shaped element 200 defines a first rod 210, a second rod 212 and connecting rod 214 extending generally transversely with respect to the first and second rods 210 and 212 and connecting therebetween. The U-shaped element 200 preferably has a U-shaped cross-section defining a circumferential groove 220 therewithin. The first and second rods 210 and 212 each have a first end 222 to which one of the rails 202 is connected. It is seen in FIG. 4 that rails 202 generally extend perpendicularly with respect to the first and second rods 210 and 212. It is also seen in FIG. 4 that rails 202 preferably have a U-shaped cross-section and a plurality of axially spaced openings 230 are formed on a base wall 232 of the rails 202. The width of the base wall 232 is d2, which is different from width d1 of base wall 192 of the first holding structure 102.

It is seen in FIG. 4 that notches 234 are formed on each of the rails 202 to provide possibility of a further size adjustment for the adjustable frame 106 upon mounting within the duct 108, the rails 202 are adapted to be cut along these pre-defined notches 234 if required to fit the adjustable frame 106 into a small duct 108.

Figure 5B:
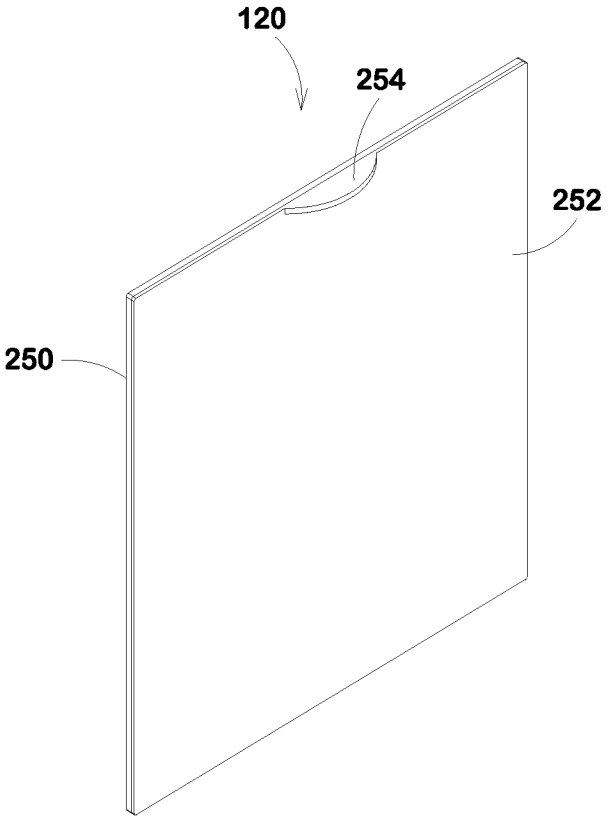
FIGS. 5A and 5B are simplified respective exploded and assembled pictorial illustrations of a reflective surface assembly, forming part of the disinfection system of FIG. 1.
Figure 5A:
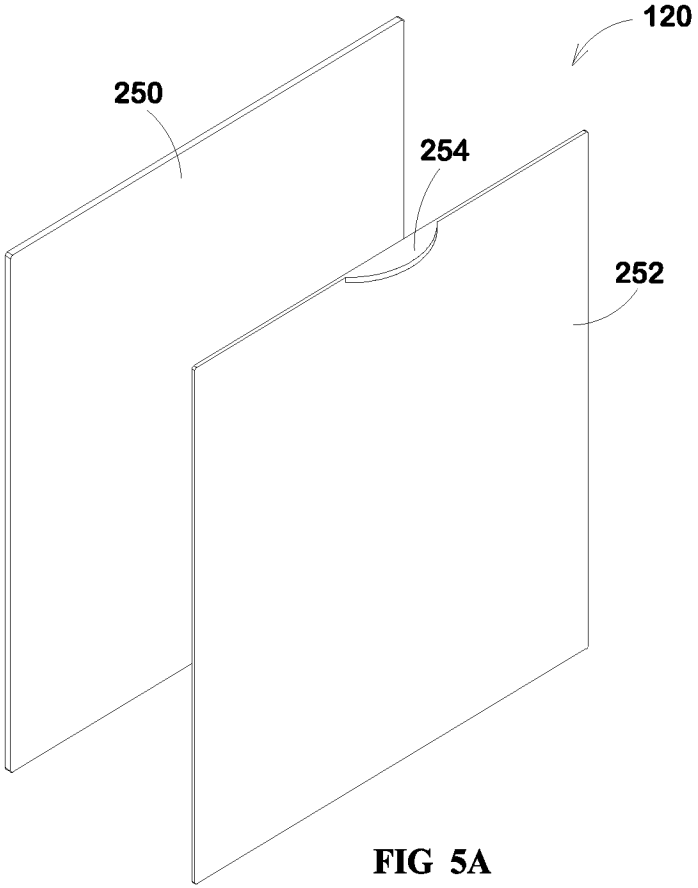

Reference is now made to FIGS. 5A and 5B, which are simplified respective exploded and assembled pictorial illustrations of the reflective surface assembly 120, forming part of the disinfection system 100 of FIG. 1.

It is seen in FIG. 5 that the reflective surface assembly 120 preferably includes a holder 250 and a mirror 252 with a gripping rim 254 attached thereto. The gripping rim 254 preferably extend transversely with respect to the plane of the mirror 252, thus configured to be gripped by a user.

The holder 250 is preferably a flat element integrally or fixedly attached to one side of the mirror 252. Alternatively, the mirror 252 can be placed within a circumferential holder, providing for collection of debris therewithin in the event of mirror breakage.

Figure 6:
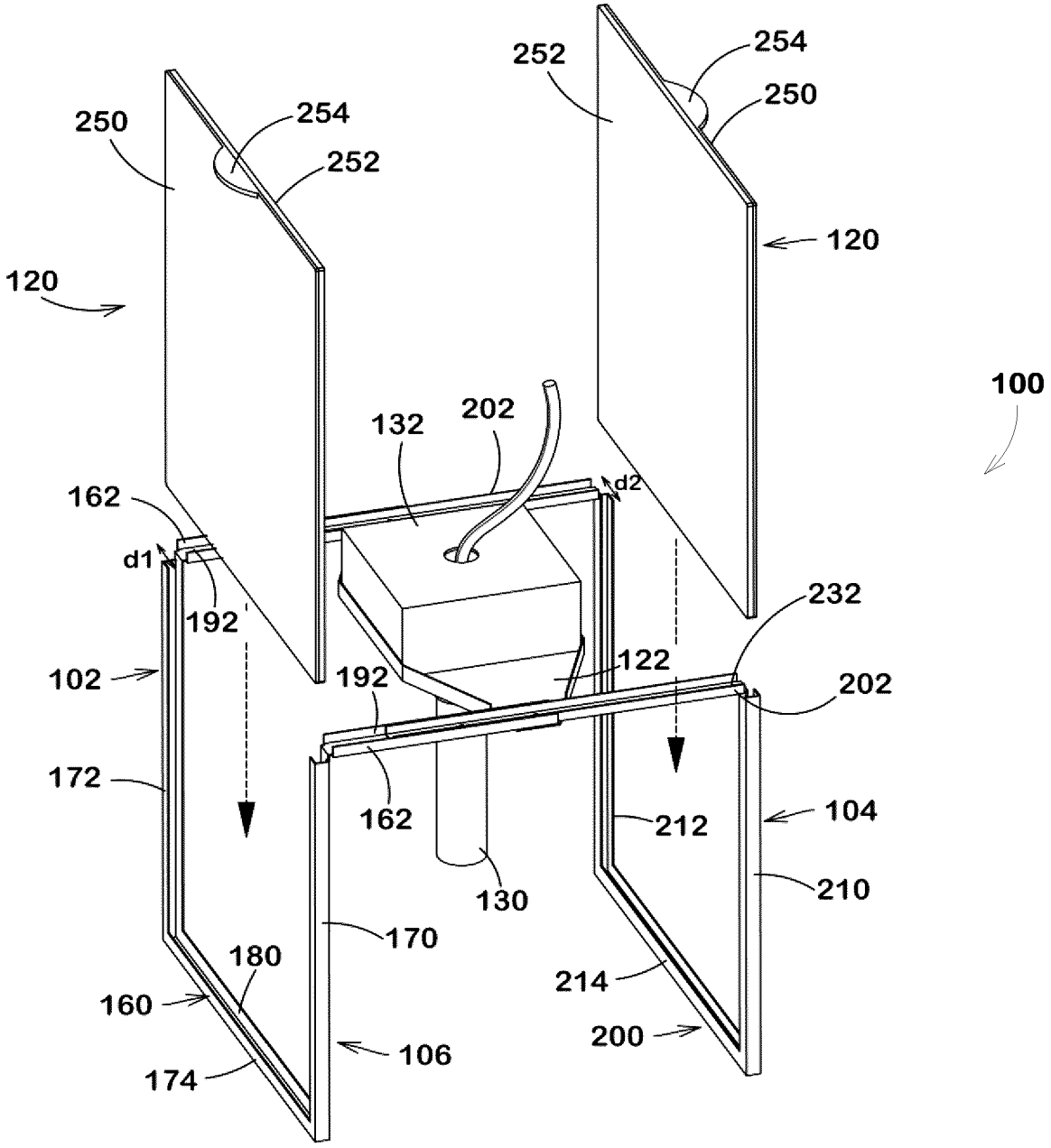
FIG. 6 is a simplified pictorial illustration of the disinfection system of FIG. 1, shown prior to insertion of the reflective surface assemblies of FIGS. 5A and 5B thereinto.

Reference is now made to FIG. 6, which is a simplified pictorial illustration of the disinfection system 100 of FIG. 1, shown prior to insertion of the reflective surface assemblies 120 of FIGS. 5A and 5B thereinto.

The disinfection system 100 is shown just prior to insertion of the reflective surface assemblies 120 thereinto in FIG. 6. It is seen that the second holding structure 104 is attached to the first holding structure 102 in a slidable manner.

It is a particular feature of an embodiment of the present invention that the second holder structure 104 is slidably moveable relative to the first holding structure 102 so as to form the adjustable frame 106, which can fit into different sizes of ducts 108. It is particularly seen in FIG. 6 that the rails 202 of the second holding structure 104 are partially inserted into rails 162 of the first holding structure 102 and are slidable therewithin. The base wall 232 of the second holding structure 104 is supported upon base wall 192 of the first holding structure 102 due to the fact that the width d1 of base wall 192 is greater than the width d2 of base wall 232.

The bracket 122 is fixedly connected to both base walls 192 and 232 of the first and second holding structures 102 and 104 respectively using any suitable fastening means inserted through openings 156 of bracket 122, openings 190 of the first holding assembly 102 and openings 230 of the second holding assembly 104. Alternatively, the bracket 122 can only be attached to one of the first holding structure 102 or the second holding structure 104, thus allowing relative movement between the two holding structures 102 and 104 even after attachment of the bracket 122.

It is seen that one reflective surface assembly 120 is adapted to be inserted into circumferential groove 180 of the first holding structure 102 and another reflective surface assembly 120 is adapted to be inserted into circumferential groove 220 of the second holding structure 104. The rim 254 generally protrudes laterally from the mirror 252.

The UV-C lamp 130 is preferably inserted through opening 134 in bracket 122 and extends downwardly therefrom, generally in a central location between U-shaped structure 160 of the first holding structure 102 and U-shaped structure 200 of the second holding structure 104. The electrical box 132 is preferably supported on top of the bracket 122. The UV-C lamp 130 is generally extends in parallel to both of the reflective surface assemblies 120.

Figure 7A:
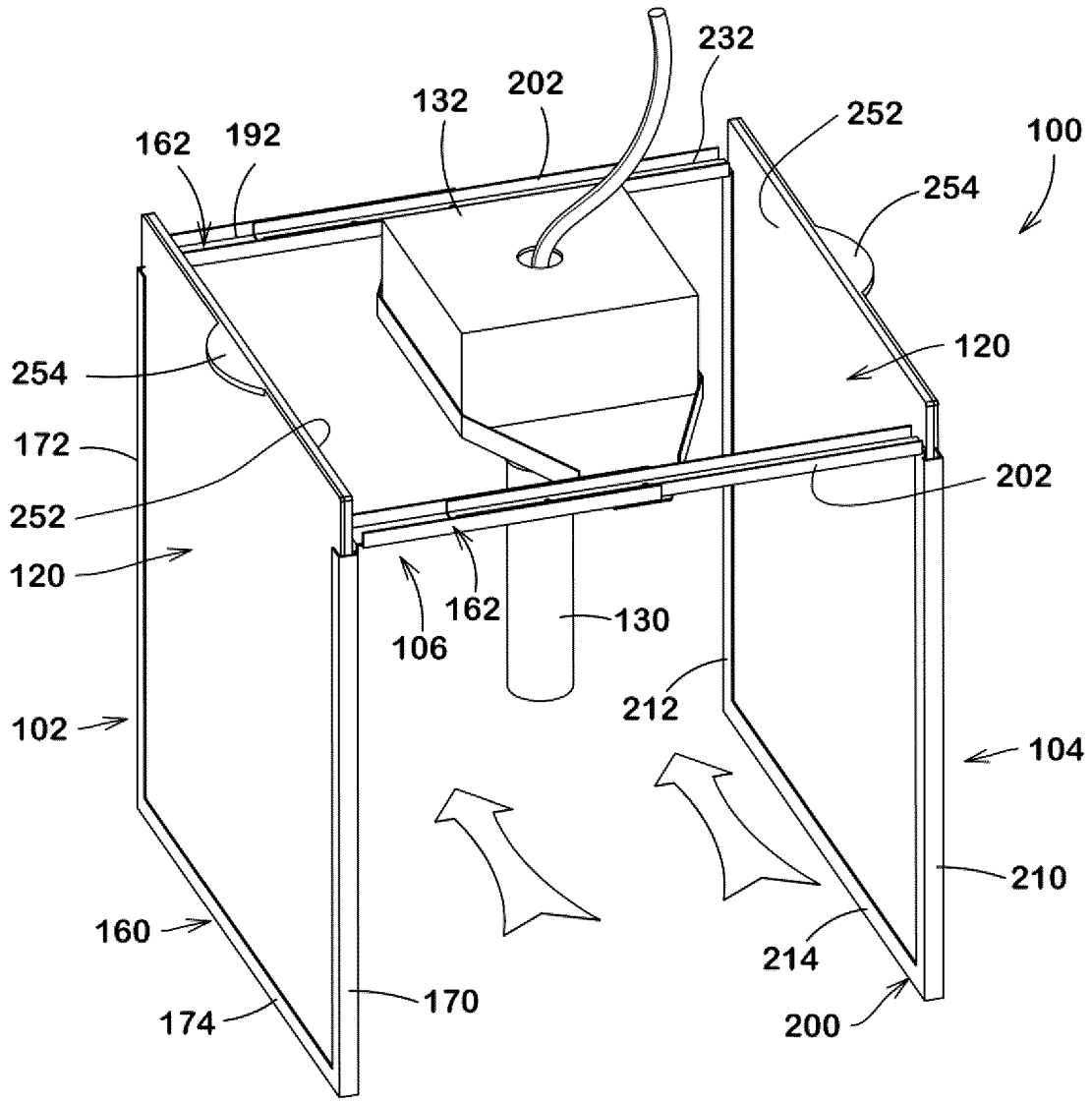
FIGS. 7A-7C are simplified respective two different pictorial illustrations shown from different directions and a top elevation view of the assembled disinfection system of FIG. 1.
Figure 7B:
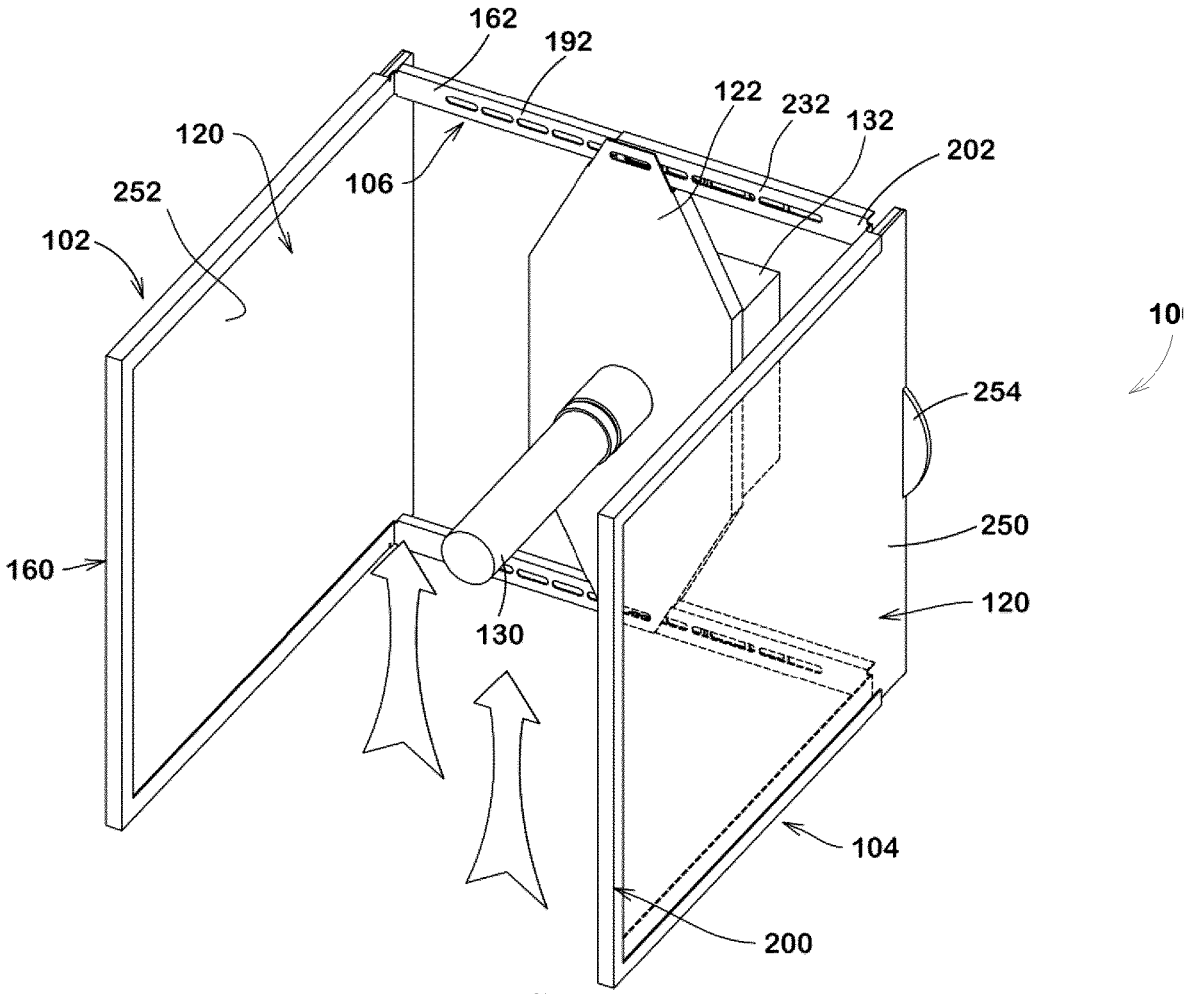
Figure 7C:
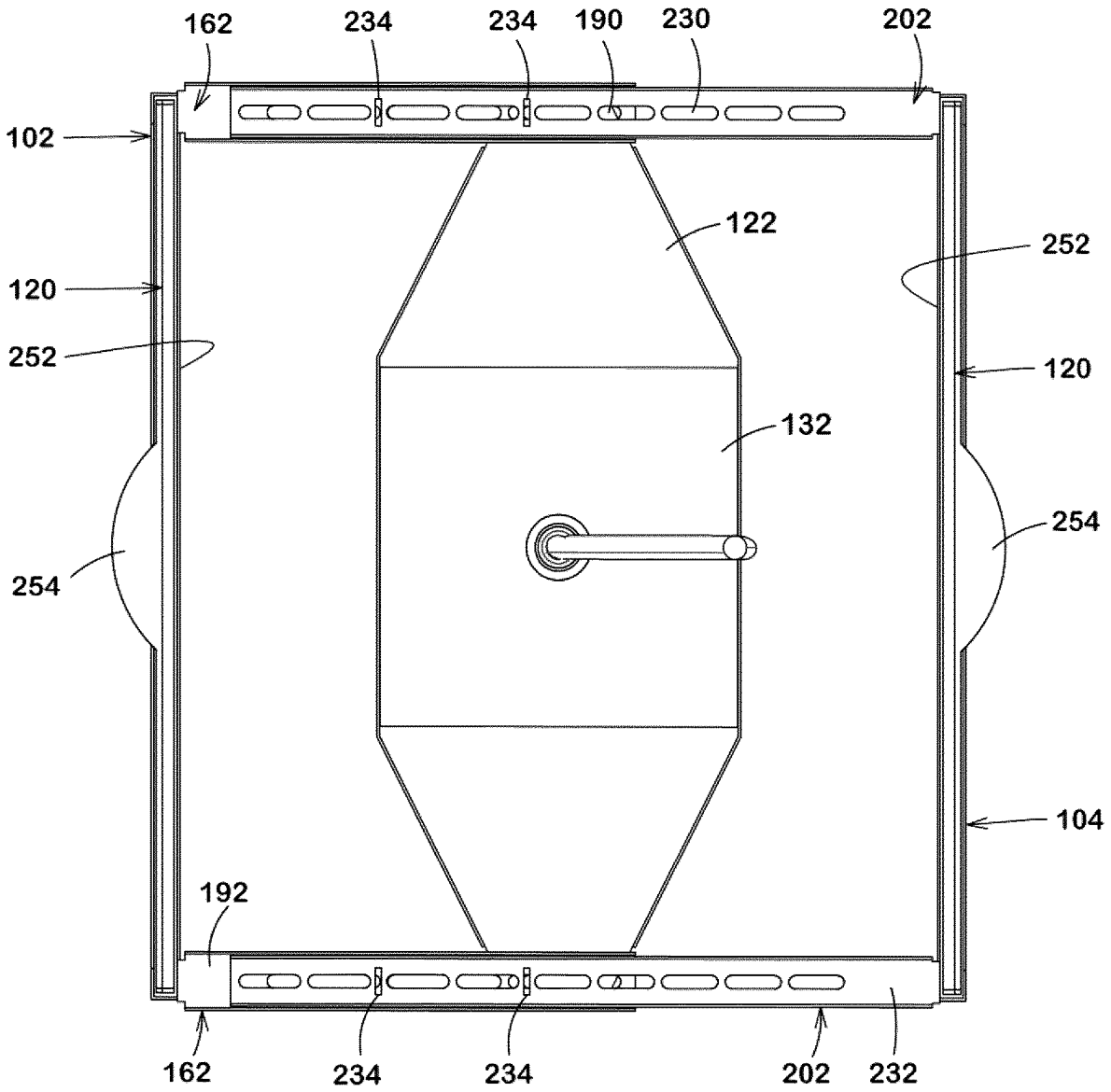

Reference is now made to FIGS. 7A-7C, which are simplified respective two different pictorial illustrations shown from different directions and a top elevation view of the assembled disinfection system 100 of FIG. 1.

It is seen in FIG. 7 that the reflective surface assemblies 120 are now mounted onto the adjustable frame 106, such that one reflective surface assembly 120 is inserted into circumferential groove 180 of the first holding structure 102 and another reflective surface assembly 120 is inserted into circumferential groove 220 of the second holding structure 104.

The remaining spatial relationships between the various components of the disinfection system 100 are generally the same as described and illustrated in FIG. 6. It is specifically seen in FIG. 7C that the rails 202 of the second holding structure 104 are almost fully inserted into the rails 162 of the first holding structure 102 and overlap therewith. It is noted that in the event that the adjustable frame 106 needs to be shortened, such that the distance between the reflective surface assemblies 120 needs to be minimized, the rails 202 of the second holding structure 104 may be cut along notches 234.

Figure 8C:
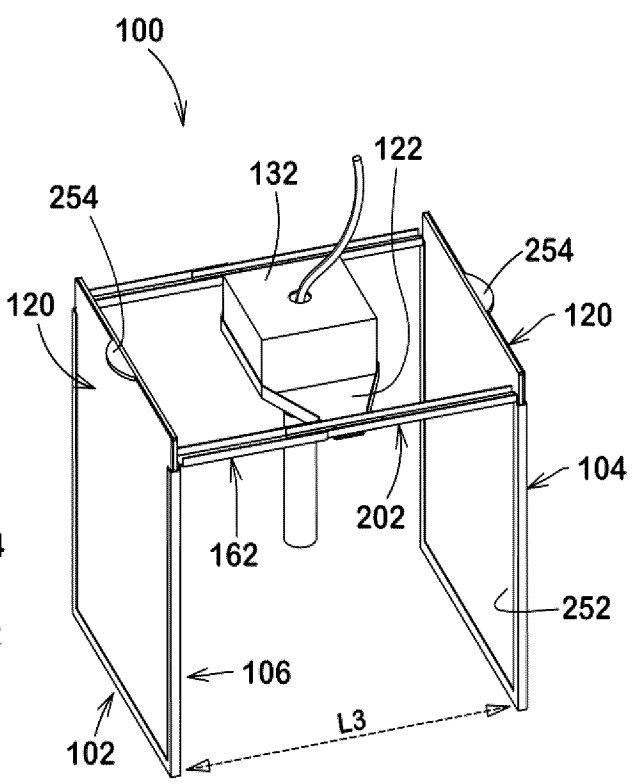
FIGS. 8A-8C are simplified pictorial illustrations, each showing different dimensions of the assembled disinfection system of FIG. 1.
Figure 8B:
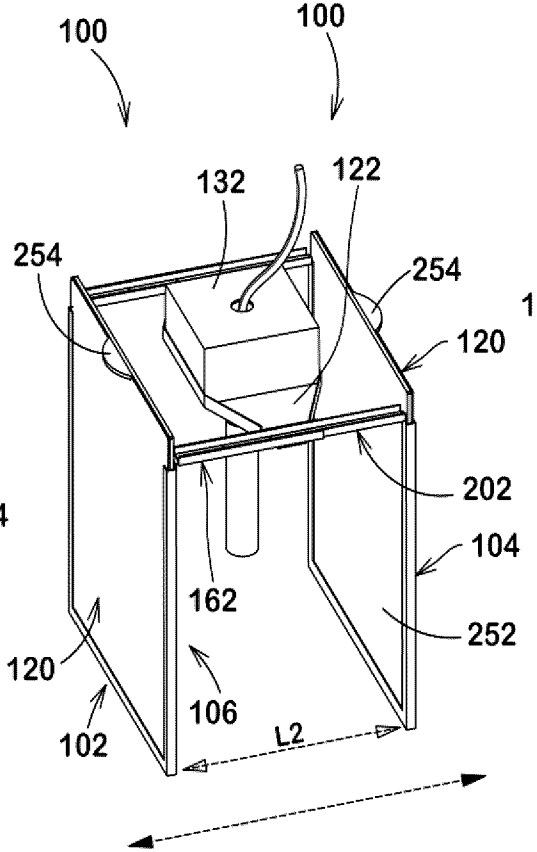
Figure 8A:
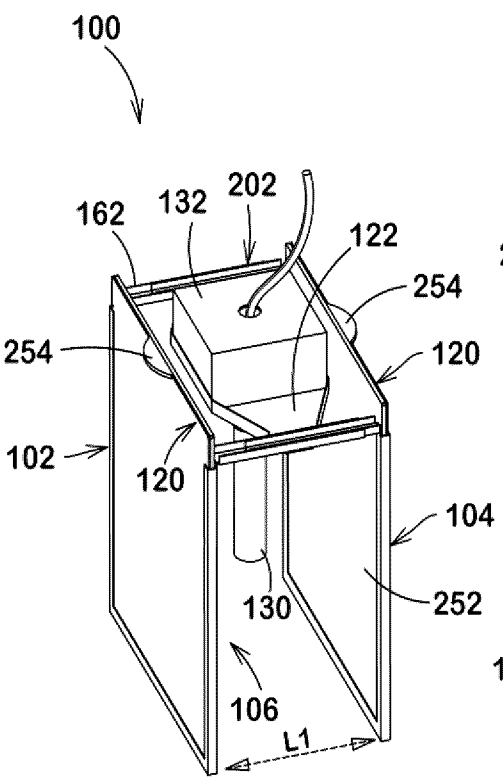

Reference is now made to FIGS. 8A-8C, which are simplified pictorial illustrations, each showing different dimensions of the assembled disinfection system 100 of FIG. 1.

It is seen in FIG. 8 A that the adjustable frame 106 of the assembled disinfection system 100 is adjusted similarly to the illustrations shown in FIGS. 7A-7C, where the rails 202 of the second holding structure 104 almost fully overlap with the rails 162 of the first holding structure 102, thus forming a relatively narrow adjustable frame 106, adapted to be fitted into a relatively small duct 108. The distance between the two reflective surface assemblies 120 in FIG. 8A is defined as LI.

It is seen in FIG. 813 that the adjustable frame 106 of the assembled disinfection system 100 is adjusted such that it slightly wider than shown in illustrations of FIGS. 7A-7C, where the rails 202 of the second holding structure 104 overlap less with the rails 162 of the first holding structure 102 in comparison with FIG. 8A, thus forming a relatively wider adjustable frame 106, adapted to be fitted into a relatively greater duct 108. The distance between the two reflective surface assemblies 120 in FIG. 8B is defined as L2, which is preferably greater than L1.

Figures 9A, 9B, 9C:
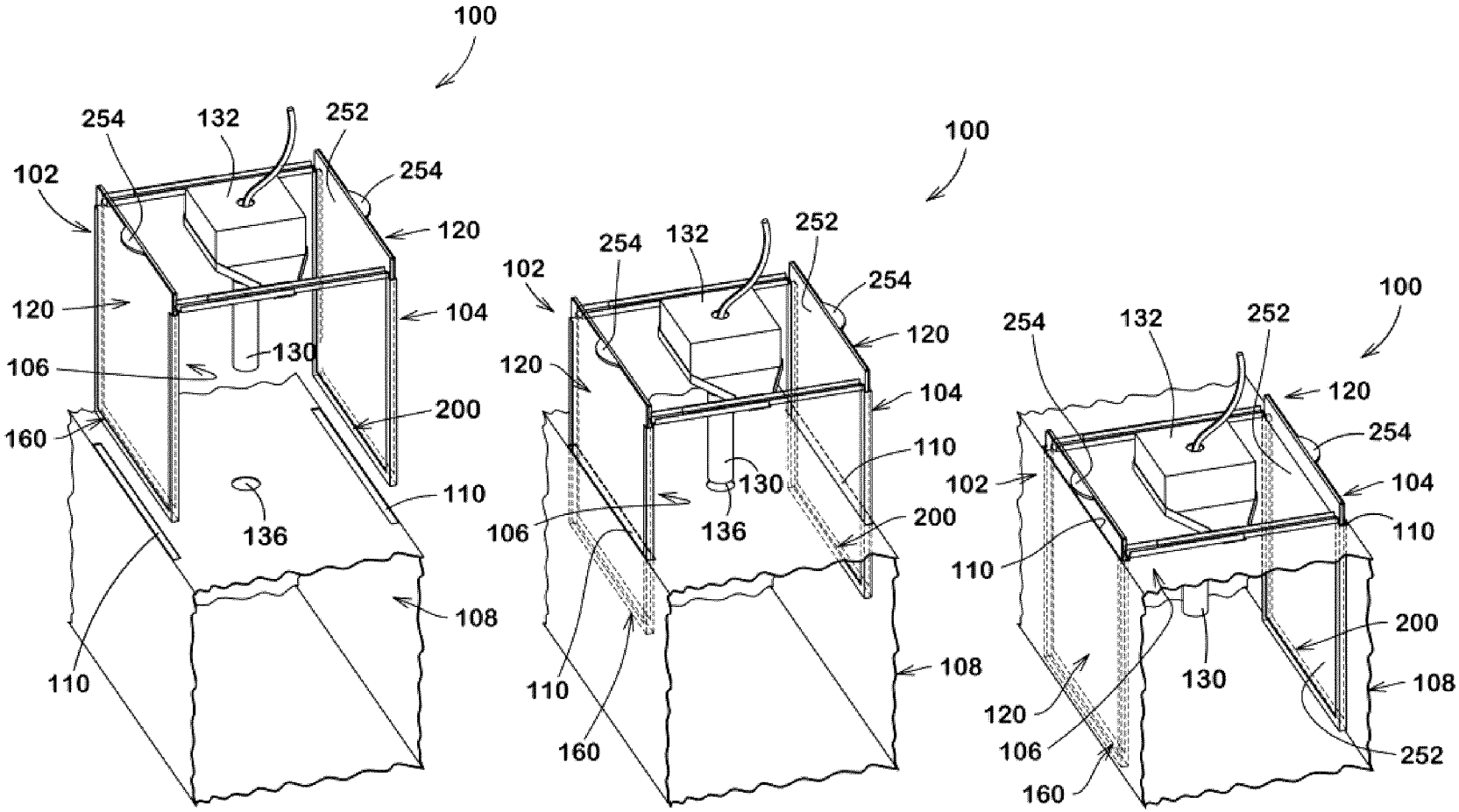
FIGS. 9A-9C are simplified pictorial illustrations of the assembled disinfection system of FIG. 1, shown in different stages of mounting thereof into an HVAC system.

It is seen in FIG. 8C that the adjustable frame 106 of the assembled disinfection system 100 is adjusted such that it even wider than shown in FIG. 8B, where the rails 202 of the second holding structure 104 overlap even less with the rails 162 of the first holding structure 102 in comparison with FIG. 8B, thus forming an even wider adjustable frame 106, adapted to be fitted into an even greater duct 108. The distance between the two reflective surface assemblies 120 in FIG. 8C is defined as L3, which is preferably greater than L2. Reference is now made to FIGS. 9A-9C, which are simplified pictorial illustrations of the assembled disinfection system 100 of FIG. 1, shown in different stages of mounting thereof into an HVAC system.

It is seen in FIG. 9A that the adjustable frame 106 of the assembled disinfection system 100 is adjusted to fit the particular size of the duct 108, such that u-shaped structure 160 of the first holding structure 102 is adapted to be inserted into one of openings 110 formed in the duct 108 and the u-shaped structure 200 of the second holding structure 104 is adapted to be inserted into another one of openings 110 formed in the duct 108. The UV-C lamp 130 is adapted to be inserted through opening 136 formed in the duct 108.

It is seen in FIG. 9B that the assembled disinfection system 100 of FIG. 9A is partially mounted into the duct 108 and the UV-C light is nearly inserted through opening 136 of the duct 108.

It is seen in FIG. 9C that the disinfection system 100 is now fully mounted into the duct 108, such that the u-shaped structures 160 and 200 of the first and second holding structures 102 and 104 respectively are inserted through openings 110 in the duct 108 and the UV-C lamp 130 extends downwardly from the bracket 122 into the inner volume of the duct 108 and is disposed generally in the middle between the two reflective surface assemblies 120, that are inserted into the grooves 180 and 220 of the first and second holding structures 102 and 104 respectively.

It is noted that the openings 110 are preferably formed near the opposite sides of the duct 108, and due to the ability to adjust the frame 106, the reflective surface assemblies 120 preferably abut the opposite sides of the duct 108, thus exposing the entire air in the system to the disinfecting light of UV-C lamp 130.

It is seen in FIG. 9C that the rails 162 and 202, the bracket 122 and the electrical box 132 are all disposed and supported on top of the duct 108.

It is a particular feature of an embodiment of the present invention that rims 254 of the two reflective surface assemblies 120 are disposed outside of the duct 108 and are adapted to be released from grooves 180 and 220 by pulling the reflective surface assemblies 120 upwardly using the rims 254 in order to clean any debris accumulated on the mirrors 252 and thus increase their efficiency in reflecting the light of the UV-C lamp 130.

Figure 10A:
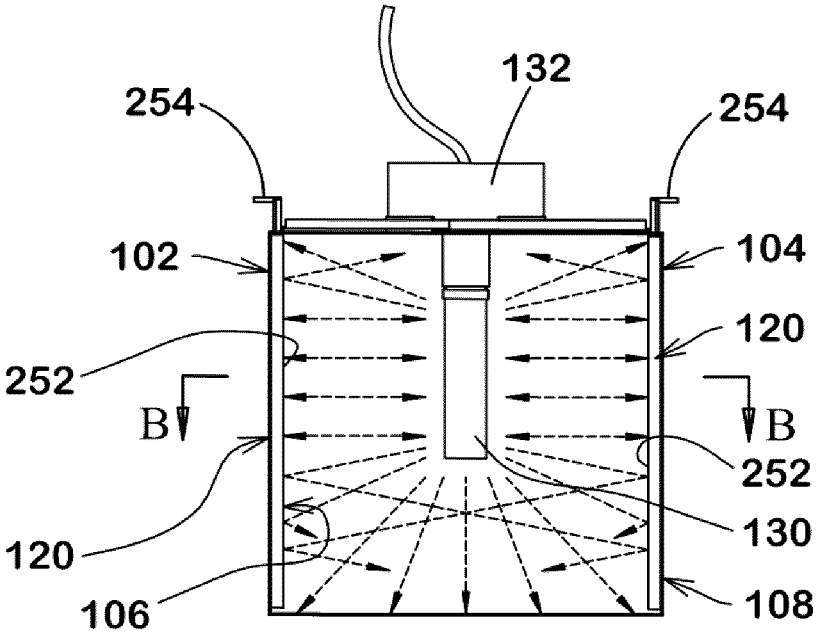
FIGS. 10A and 10B are simplified respective side view and section view illustrations of the light distribution within the HVAC system while the disinfection system of FIG. 1 is mounted thereinto, section being taken along lines B-B in FIG. 10A.
Figure 10B:
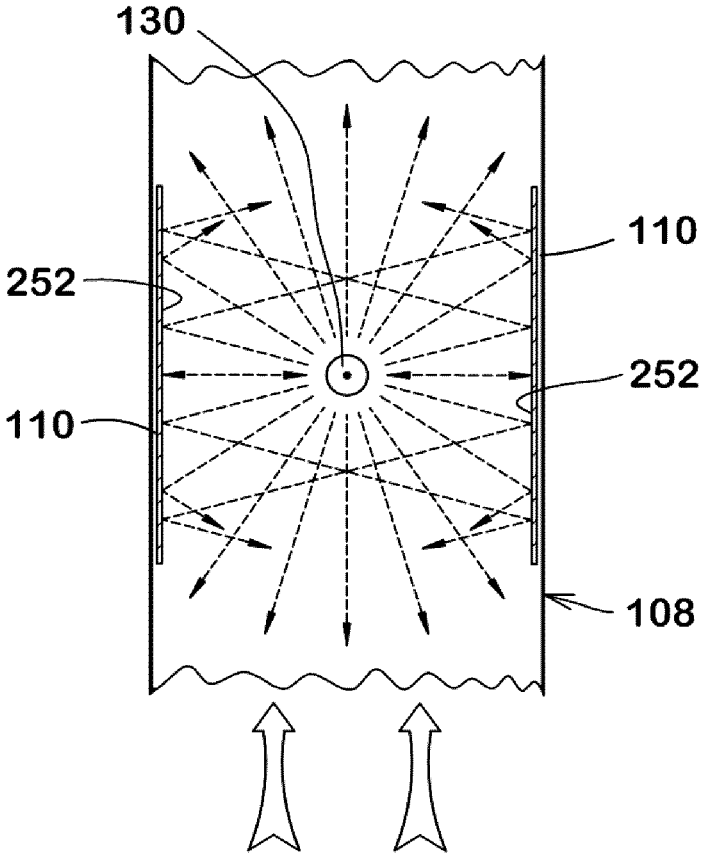

It is noted that the bracket 122 may be mounted to the adjustable frame 106 following mounting thereof into the duct 108. Reference is now made to FIGS. 10A and 10B, which are simplified respective side view and section view illustrations of the light distribution within the HVAC system while the disinfection system 100 of FIG. 1 is mounted thereinto, section being taken along lines B-B in FIG. 10A.

It is seen in FIGS. 10A and 10B that the adjustable frame 106 is adjusted such that the reflective surface assemblies 120 abut the opposite sides of the duct 108 and the UV-C light 130 is positioned in the center of the duct 108 to provide for optimal light distribution throughout the volume of the passing air.

It is a particular feature of an embodiment of the present invention that positioning of the UV-C lamp 130 in the center of the duct 108, while the reflective surface assemblies 120 are disposed adjacent the opposite sides of the duct 108 increase the efficiency of the disinfecting system 100 by reflecting up to 94% of the UV-C light generated by the lamp 130.

It will be appreciated by persons skilled in the art that the present invention is not limited by what has been particularly shown and described hereinabove. Rather the scope of the present invention includes both combinations and subcombinations of various features described hereinabove as well as variations and modifications thereof which are not in the prior art.

The invention claimed is:

1. A disinfecting system for mounting within an HVAC system, comprising:

an adjustable frame, configured for adjustment of the width thereof, and having a first groove and a second groove disposed on the opposite sides of said adjustable frame;

a first reflective surface assembly configured to be releasably inserted into said first groove and a second reflective surface assembly configured to be releasably inserted into said second groove; and a lamp configured to be connected to said adjustable frame and located between said first and second reflective surface assemblies and wherein at least one of said first and second reflective surface assemblies has a circumferential holder receiving a mirror therein.

2. The disinfecting system of claim 1, and wherein said adjustable frame, comprises a first holding structure; and a second holding structure; wherein said first holding structure and said second holding structure are slidably moveable with respect to each other, thereby adjusting the width of said adjustable frame.

3. The disinfecting system of claim 2, and wherein at least a portion of said adjustable frame is adapted to be inserted into at least one opening formed in a duct of said HVAC system.

4. The disinfecting system of claim 3, and wherein said first holding structure comprises a first base element and a pair of first rails extending transversely with respect thereto, and wherein said first rails each have a first base wall having a first width; and wherein said second holding structure comprises a second base element and a pair of second rails extending transversely with respect thereto, and wherein said second rails each have a second base wall having a second width, wherein said second width differs from said first width.

5. The disinfecting system of claim 4, and wherein said first holding structure contains said first groove for releasable insertion of said first reflective surface assembly and said second holding structure contains said second groove for releasable insertion of said second reflective surface assembly.

6. The disinfecting system of claim 4, and wherein said second base wall is slidably moveable relative to said first base wall.

7. The disinfecting system of claim 1, and wherein said lamp is adapted to be attached to said adjustable frame such that it is disposed in a central location between said first reflective surface assembly and said second reflective surface assembly.

8. The disinfecting system of claim 1, and wherein said first reflective surface assembly has a first rim for removal thereof from said first groove and said second reflective surface assembly has a second rim for removal thereof from said second groove.

* * * * *